US006341379B1

(12) United States Patent
Kokus

(10) Patent No.: US 6,341,379 B1
(45) Date of Patent: Jan. 29, 2002

(54) COMBINATION TENT-RAIN CAPE

(76) Inventor: Martin Kokus, 297 Peavine Hollow Rd., Hughesville, PA (US) 17737

( * ) Notice: Subject to any disclaimer, the term of this patent is extended or adjusted under 35 U.S.C. 154(b) by 0 days.

(21) Appl. No.: 09/812,280

(22) Filed: Mar. 20, 2001

(51) Int. Cl.[7] ..... E04H 15/30; A41D 3/08
(52) U.S. Cl. ..... 2/89; 135/95
(58) Field of Search ..... 2/84, 86–89, 93, 2/69, 69.5, 94, 108; 135/90, 95, 96, 87, 900; 224/575, 577; 383/4

(56) References Cited

U.S. PATENT DOCUMENTS

| | | | | | |
|---|---|---|---|---|---|
| 535,066 | A | * | 3/1895 | Mautner | 2/89 |
| 608,351 | A | * | 8/1898 | Terramorse | 2/89 |
| 703,245 | A | * | 6/1902 | Faulkner | 2/89 |
| 719,899 | A | * | 2/1903 | Stacey | 2/89 |
| 1,155,800 | A | * | 10/1915 | Corbet | 2/89 |
| 1,193,443 | A | * | 8/1916 | Swan | 2/89 |
| 1,252,628 | A | * | 1/1918 | Terry | 2/89 |
| 1,895,911 | A | | 10/1933 | Bosson | |
| 2,093,889 | A | | 9/1937 | Horn | |
| 2,268,317 | A | | 8/1941 | Till | |
| 2,745,105 | A | | 7/1956 | Shafer | |
| 3,837,006 | A | | 9/1974 | Laseman | |
| 4,484,362 | A | | 11/1984 | Asher | |
| 4,594,735 | A | | 6/1986 | Rolf | |
| 4,703,521 | A | | 11/1987 | Asher | |
| 5,217,034 | A | | 6/1993 | Yih et al. | |
| 5,769,106 | A | | 6/1998 | Achuff | |
| 5,924,132 | A | | 7/1999 | Wigutow | |

* cited by examiner

*Primary Examiner*—John J. Calvert
*Assistant Examiner*—Tejash Patel

(57) ABSTRACT

The present invention is a combination tent and rain cape. It consists of a square, waterproof tarp and a breathable triangular sheet. A hood, straps, and fasteners are attached to the top side of the tarp along a diagonal. If the tarp is folded along this diagonal, and the hood placed on the users head, the tarp can be worn as a rain cape. On the bottom side of the tarp, there are fasteners attached to two adjacent edges of the square tarp. These mate with fasteners on the triangular sheet creating the tent. The tent can then be pitched by tying only one end to an elevated support such as a tree and staking the other corners out.

1 Claim, 6 Drawing Sheets

COMBINATION TENT-RAIN CAPE

CROSS REFERENCE TO RELATED APPLICATIONS

Not applicable.

STATEMENT REGARDING FEDERALLY SPONSORED RESEARCH AND DEVELOPMENT

Not applicable.

BACKGROUND—FIELD OF THE INVENTION

This invention relates to tents and rain gear used in outdoor activities where weight savings are advantageous.

BACKGROUND—DISCUSSION OF PRIOR ART

During outdoor activities like hiking, backpacking, and bicycling, the participant carries along garments to keep him dry in case of rain while he is mobile and a tent or tarp to protect him from precipitation if he, either by plan or accident, spends the night out of doors. Because these items may not be needed at all, or if they are, are not needed at the same time; it makes sense to save weight and bulk by combining them.

Attempts to combine rain gear and tents date back at least to the civil war and the same basic design used by union soldiers continues to the present. A rain poncho consists of a rectangular, water repellent tarp with an opening near the middle for the head to pass through. To create a tent, two of these ponchos are connected and pitched in an "A." Bosson in U.S. Pat. No. 1,895,911 and Wigutow in U.S. Pat. No. 5,924,132 improved on this design. There are several disadvantages to this design. It takes two to make a tent. When worn as a rain poncho there is a great deal of material in places where it is not needed and where it is most likely to snag on something. There is not way to adjust if for ventilation, such as in the case of a light drizzle. If flaps in the wind when used as either a rain poncho or a tent.

Asher in U.S. Pat. No. 4,484,362 modifies the basic design so that its length is adjustable and makes a provision for using a single poncho as a tent. His design adds even more unwanted material in awkward places and his configuration for a tent does not stretch the fabric tightly making it likely to flap and come loose in a storm. Asher in U.S. Pat. No. 4,703,521 devises a multipurpose garment that can be used as rain gear and a tent. The design appears very complicated to manufacture and use.

Shafter in U.S. Pat. No. 2,745,105 and Horn in U.S. Pat. No. 2,093,889 offer simple designs that should work well as rain ponchos and should pitch tightly as tents; but both tents have a large open side which is a disadvantage during windy conditions.

Till in U.S. Pat. No. 2,268,317 and Laseman in U.S. Pat. No. 3,837,006 propose combination tent-rainwear that are very long and awkward when worn for rain protection.

Rolf in U.S. Pat. No. 4,594,735 modifies the basic design so that it can be pitched alone. The tent it creates is very small and complicated to pitch. The material on top would not be very tight, and it would not be very stable in the wind.

Yih et al in U.S. Pat. No. 5,217,034 use the basic rain poncho as the top of a bivouac sack and their design would probably have all of the problems associated with bivouac sacks. It would probably only offer the user comfort under the mildest of weather conditions.

Achuff in U.S. Pat. No. 5,769,106 proposes that tents and rain ponchos can be made by fastening square pieces of fabric together. This approach severely limits the design of both items.

SUMMARY

The present invention consists of a square tarp of waterproof fabric and a triangular sheet out of breathable material. A hood, straps, and fasteners are attached to the top side of the square tarp along a diagonal. If the tarp is folded along this diagonal, and the hood placed on the users head, the tarp can be worn as a rain cape. On the bottom side of the tarp there are fasteners attached to two adjacent edges. This permits the triangular sheet to be attached to the square tarp. This ensemble can be pitched as a tent by tying only one end to an elevated support such as a tree and staking out the other corners.

OBJECTS AND ADVANTAGES

The object of this invention is to provide backpackers, hikers, bicyclists, hunters and others who have to be prepared for inclement weather with a simple, compact, lightweight item that will keep them dry while they are moving and comfortable if they have to spend the night outdoors. Quite often those engaged in outdoor activities never encounter inclement weather, but they have to be prepared for it. This often requires that they carry rain gear and a tent, even though they may not need either. This invention can save then over half of the weight they would otherwise carry. Furthermore, if offers superior and more versatile rain protection than a conventional rain poncho; and it offers a lighter and easier tent to pitch than most tents on the market. In addition, the tent-rain cape is much simpler to manufacture than comparable items, enabling it to be brought to the market at a lower price.

When the tent-rain cape is used as a rain cape it very closely resembles a bicyclists rain cape and can be used as one very effectively. If fits the shoulders and upper arms more closely than a conventional rain poncho making it more effective in a strong wind or when riding a bicycle at high speeds. When standing, it hangs low immediately in front and behind the legs and does not have additional material protruding low and to the sides where it is likely to snag as the traditional rain ponchos does. It also unfastens in the front, making it easier to put on and enabling the wearer to adjust ventilation and protection to meet conditions. There are also straps that allow the wearer to just toss the cape over his back when it is not immediately needed. Although not a functional feature, this invention is more attractive than a conventional rain poncho. It resembles a renaissance cloak.

When the tent-rain cape is used as a tent, it has many advantages. It is designed to be pitched by tying one end to a tree and staking the other corners out. If a tree is not available it can be pitched with one pole which is about the height of a typical hikers staff. This eliminates the weight of poles or wands. It is much more spacious than shelters usually created by pitching rain ponchos. The user can sit up or kneel inside the tent and two people can squeeze into it.

DRAWING FIGURES

Figure 1:
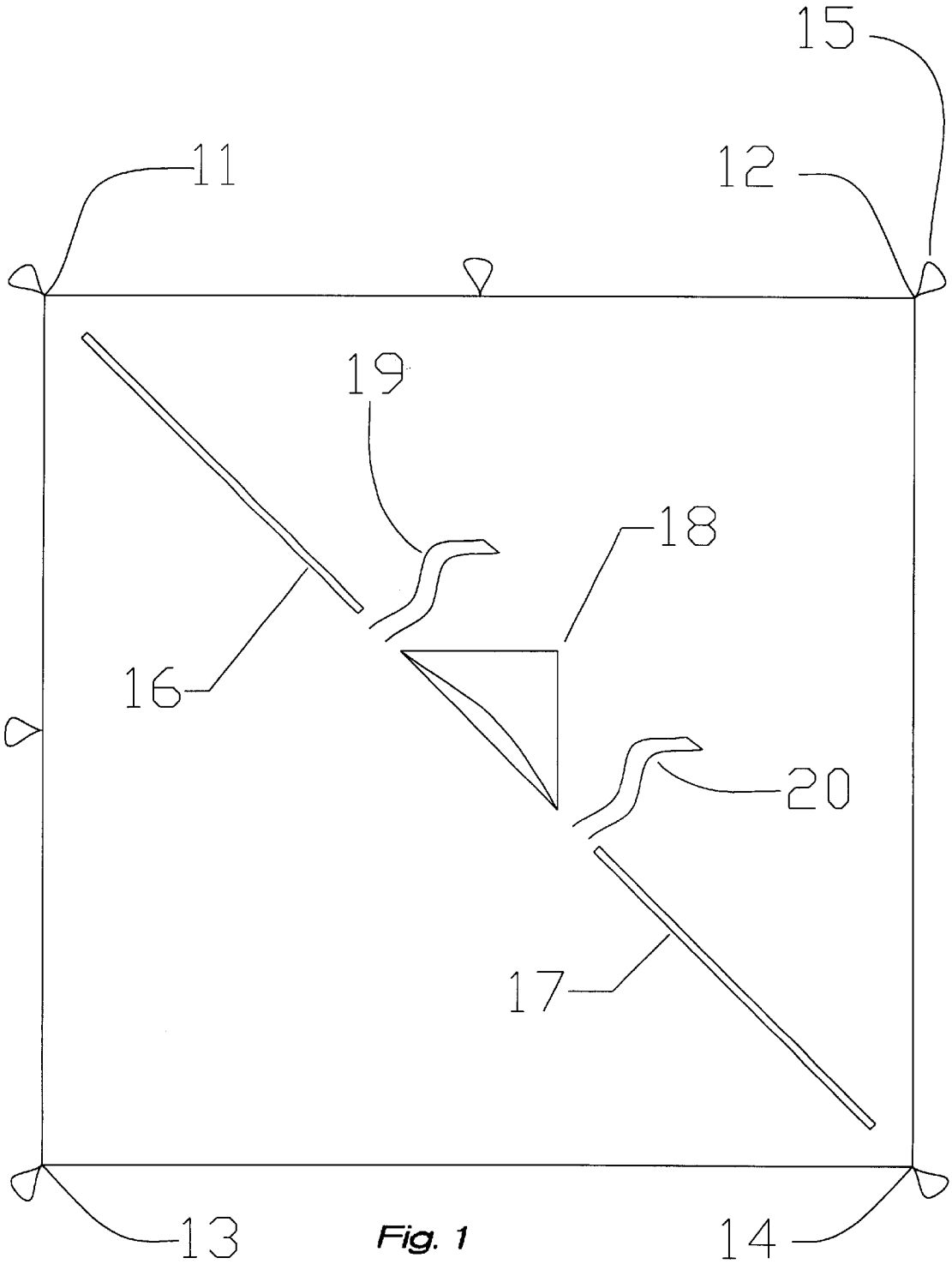
FIG. 1 shows the top side of the square tarp when it is laid flat illustrating the fasteners, straps, and hood which are used to create the rain cape.

| REFERENCE NUMERALS IN DRAWINGS | |
|---|---|
| 11, 12, 13, 14 | corners of tarp-tent-rain cape |
| 15 | grommets or tie loops |
| 16, 17 | matching fasteners |
| 18 | hood |
| 19, 20 | matching straps |
| 21 | fasteners |
| 22 | fasteners that will mate with 21 |
| 23 | matching fasteners |
| 24, 25, 26 | corners of isosceles triangle |
| 27 | rope to tree branch, etc. |

DESCRIPTION-MAIN EMBODIMENT

The embodiment of the combination tent-rain cape is a square tarp with various fasteners, straps and a hood attached to it, and a triangular sheet with fasteners attached to it. The square tarp is made out of waterproof fabric. The triangular sheet is made out of netting or breathable fabric.

FIG. 1 illustrates the top side of the square tarp. Its corners are denoted by 11, 12, 13, and 14. A hood 18, straps 19 and 20, and mateable fasteners 16 and 17 lie along a diagonal running from corners 11 to 14. Grommets or ties along the periphery are denoted by 15.

Figure 2:
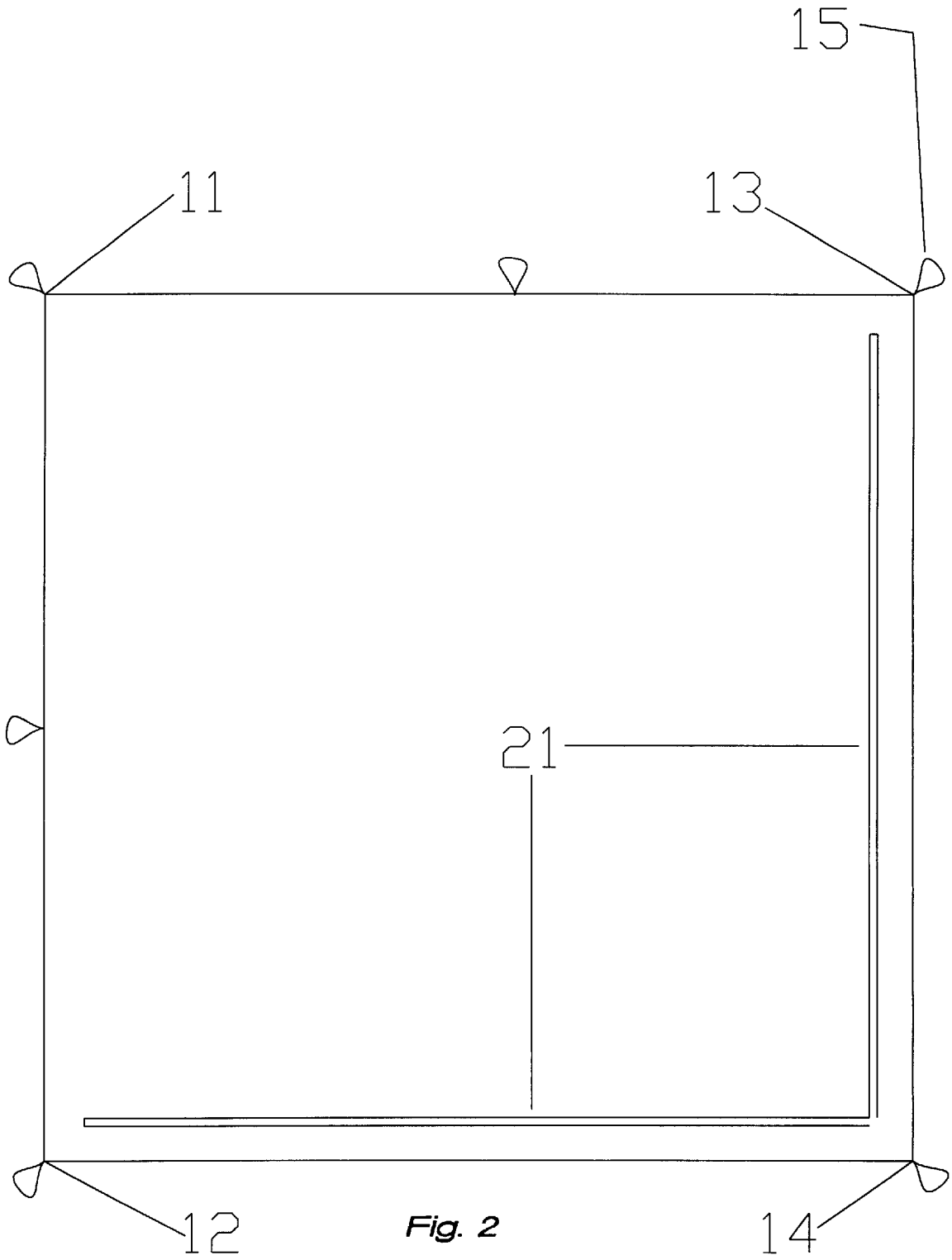
FIG. 2 shows the bottom side of the square tarp revealing the fasteners that are used to attach the triangular sheet which is used to turn the tarp into a tent.

FIG. 2 illustrates the bottom side of the square tarp. On the bottom are fasteners 21.

Figure 3:
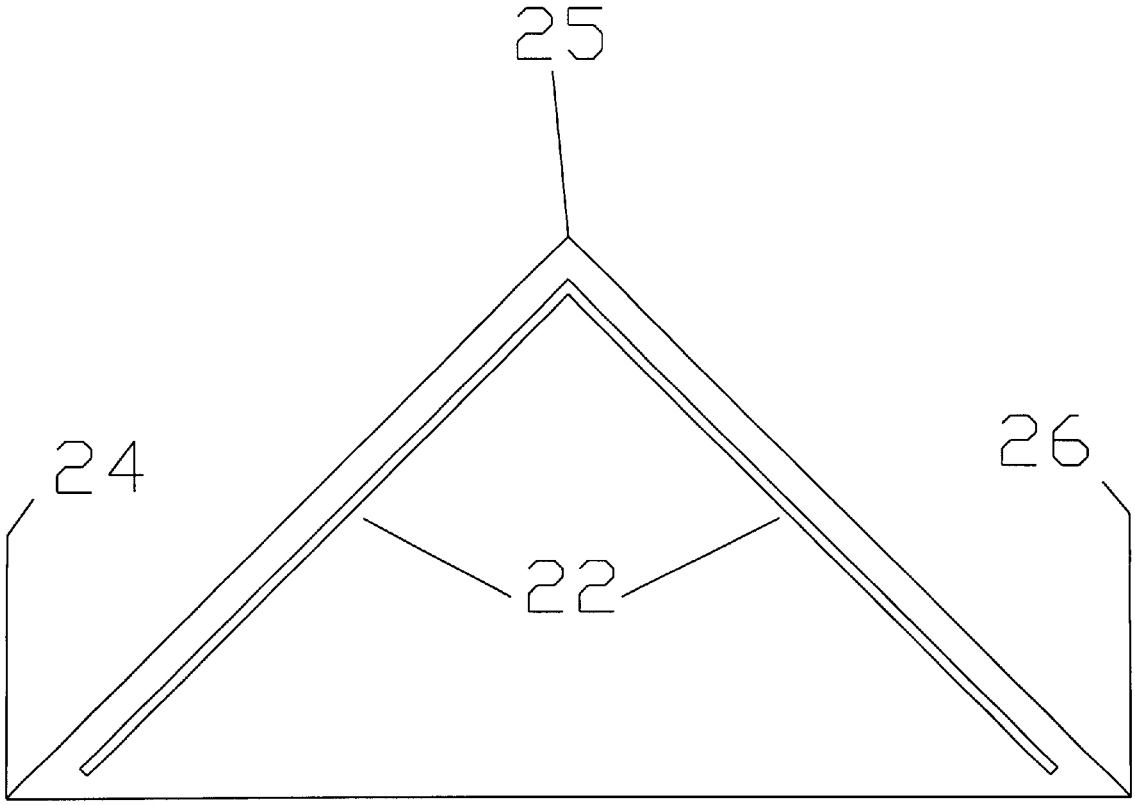
FIG. 3 shows the triangular sheet that is fastened to the square tarp to create the tent.

FIG. 3 illustrates the triangular sheet. Its corners are denoted by 24, 25, and 26. The fasteners 22 are to mate with fasteners 21 on the square tarp when the two are combined into a tent.

Figure 4:
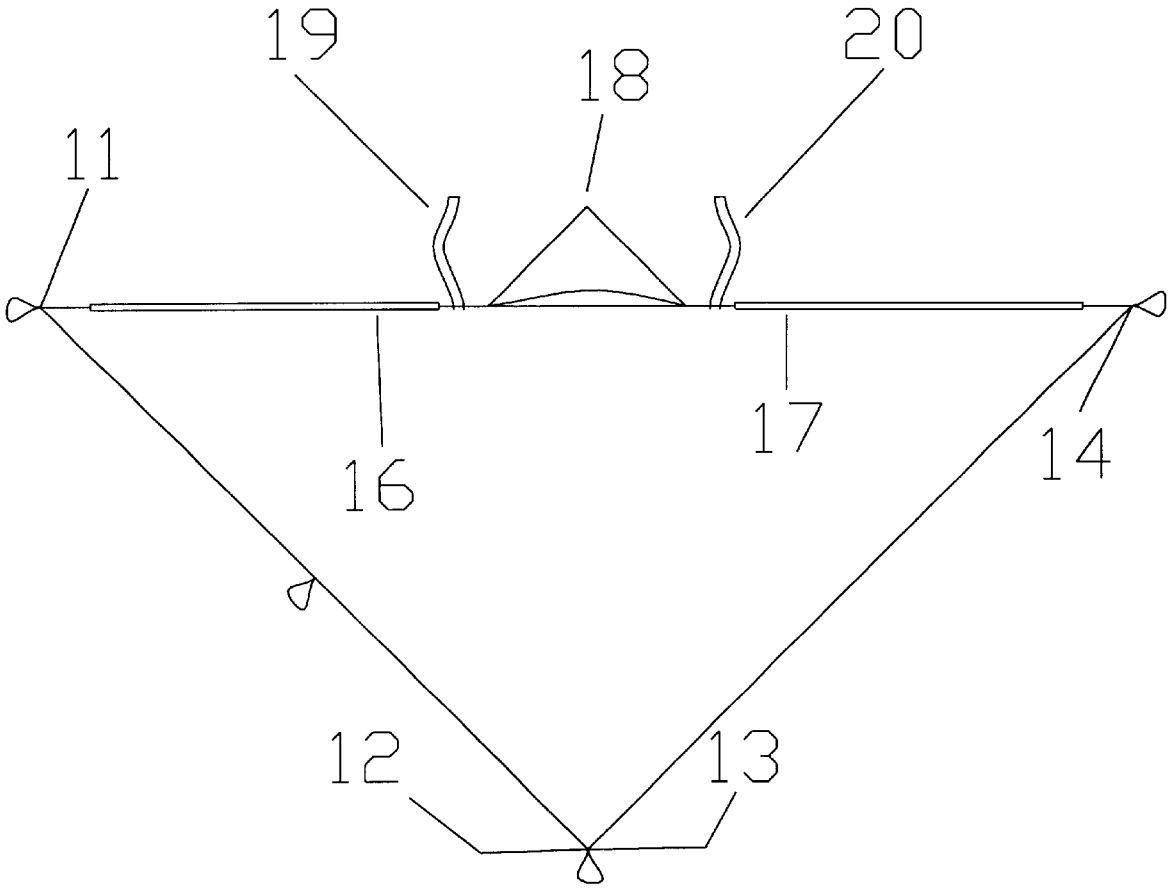
FIG. 4 shows the square tarp folded along a diagonal, forming a rain cape.

FIG. 4 shows the square tarp when it is folded about a line running from corner 11 to corner 14 so that corner 13 lies on top of corner 12 with the hood 18, the straps 19 and 20, and the fasteners 16 and 17 exposed.

Figure 5:
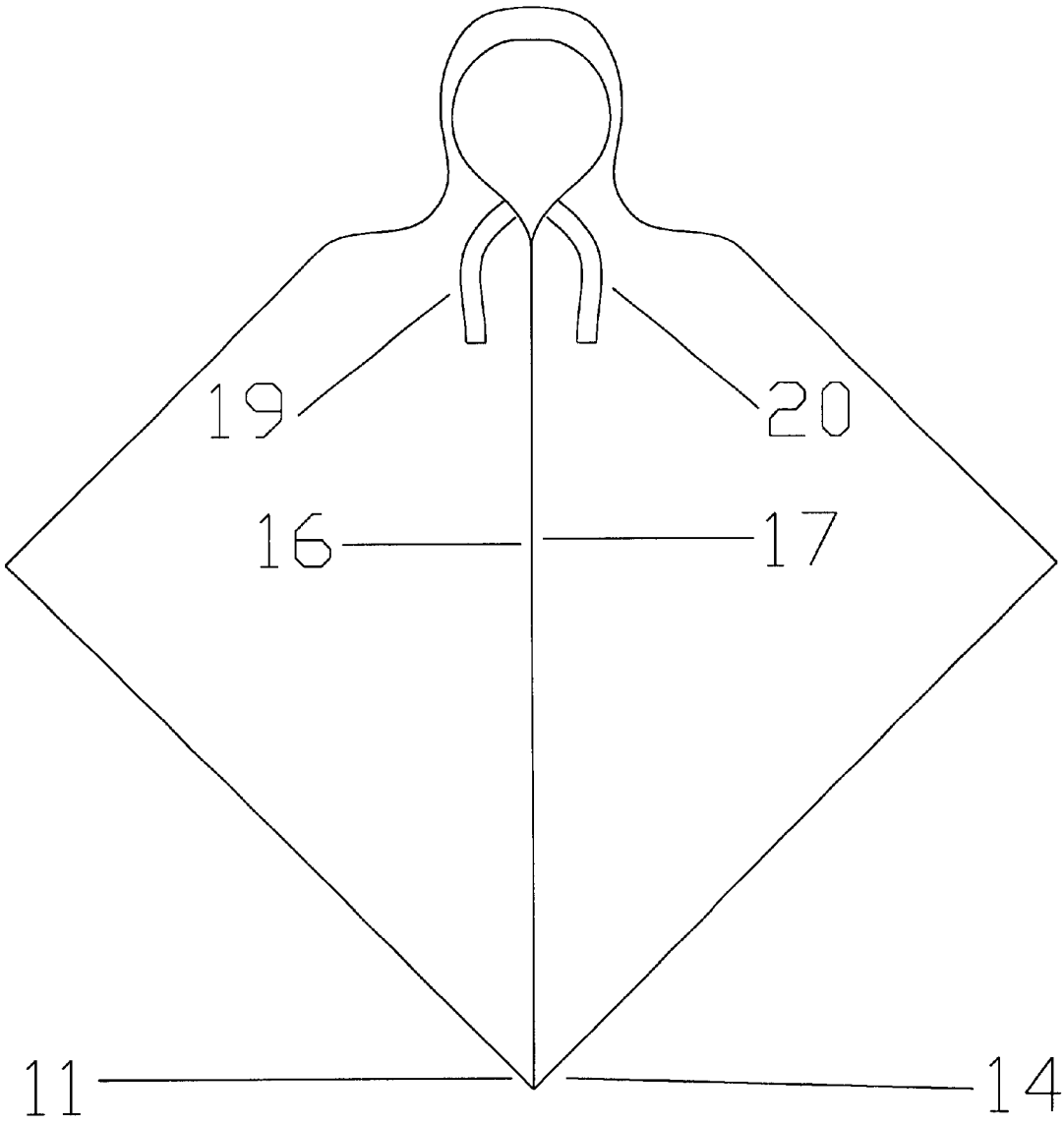
FIG. 5 shows the rain cape as it is to be worn.

FIG. 5 illustrates the raincape. Starting from the configuration in FIG. 4, the fasteners 16 and 17 are brought together and corners 11 and 14 are brought together over corners 12 and 13.

Figure 6:
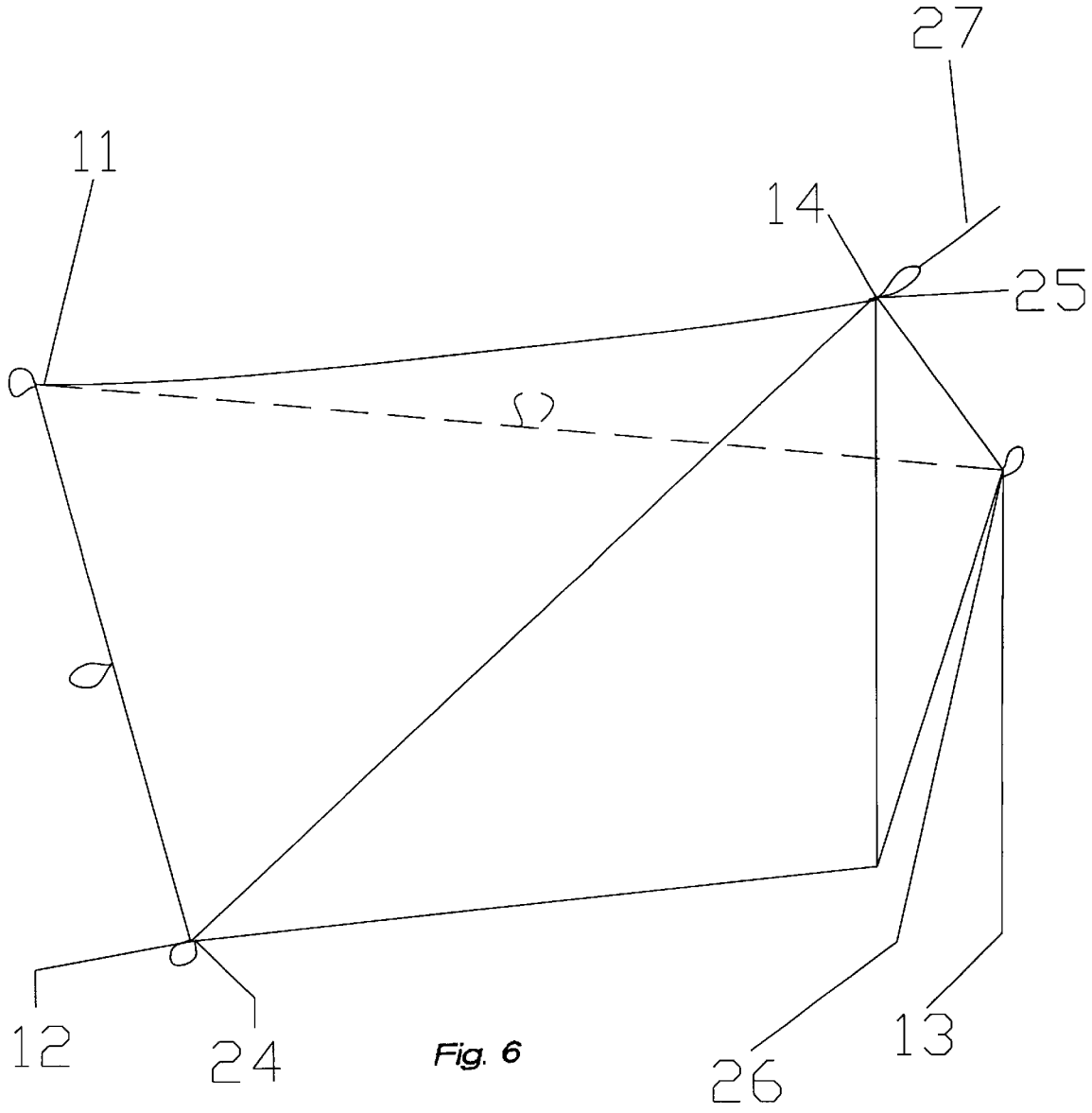
FIG. 6 is an isometric view showing the square tarp with triangular sheet attached and pitched as a tent.

FIG. 6 illustrates the tent. Fasteners 22 on the triangular tarp are fastened to fasteners 21 on the square tarp bringing corners 12, 14, and 13 on the square top to corners 24, 25, and 26 on the triangular tarp respectively. The one guideline, 27, is running to a tree or some other elevated support.

OPERATION-MAIN EMBODIMENT

To use the tent-rain cape, start with the square tarp in FIG. 1 and fold it along the diagonal line running from corner 11 to corner 14 so that corner 12 is under corner 13 and the hood 18, straps 19 and 20, fasteners 16 and 17 are exposed as in FIG. 3. Then, with the hood on the users head, fasteners 16 and 17 are brought together along with corners 11 and 14 as illustrated in FIG. 5. Fasteners 16 and 17 can be fastened and the rain cape can be worn like a conventional rain poncho or bicyclist rain cape. Fasteners 16 and 17 can be left unfastened and straps 19 and 20 can be fastened. Then the cape can be worn open or it can be thrown back over the shoulders.

To use the tent-rain cape as a tent, start with the square tarp with its bottom side up as in FIG. 2. Place the triangular tarp from FIG. 3 on top of it so that corner 24 is on top of corner 12, corner 25 is on top of corner 14 and corner 26 is on top of corner 13. Attach fasteners 22 to fasteners 21. Tie the grommet or tie loop at corner 14 to a tree or pole so that its height above the ground is approximately one half of the diagonal distance between corners 11 and 14. Stake out corner 11 so that fabric between corners 11 and 14 is tight. Then stake out corners 12 and 13 to maximize tension in the square tarp. Then stake out the other grommets or tie loops on the square tarp. The tent can be entered by either picking up the triangular tarp and crawling underneath it or unfastening it. Tension can be applied to the triangular tarp several different ways. One of the most effective is to curl its lower end into the tent and put extra camping gear or stones on top of it. Tie loops could also be positioned on the inside of the triangular tarp and it could be staked down from the inside.

CONCLUSIONS, RAMIFICATIONS, AND SCOPE OF THE INVENTION

The tent-rain cape can not only provide weight and bulk savings to backpackers, hikers, hunters, and others who might have to spend the night outdoors under adverse conditions, but it is also an improvement in function over the items commonly used. By reducing the weight of the bare essentials that outdoor enthusiasts should carry with them, it makes it more likely that they will be prepared for an emergency.

Many modifications can be made to the basic invention that may improve its effectiveness under certain conditions.

Provisions could be made for attaching a floor or a floor with short walls to the tent. Provisions could be made to attach both a water repellent and netting triangular sheet to the front of the tent.

A tuck or dart could be sewn into the square tarp along the diagonal connecting corners 11 and 14 so that the tent will be more rigid.

Fasteners 22 on the triangular sheet could be curved so that the tent will be more rigid.

A dart or tuck could be placed in the triangular sheet between corner 25 and the midpoint of the long side so that the tent would be more rigid.

The triangular sheet could be made out of a very light material and sewn to the square tarp. Then some provision could be made to hold the sheet and tarp together while they were being used as a rain cape. This could simplify the design and reduce costs.

I claim:

1. A combination tent-rain cape, comprising:

(a) an approximately square tarp having corners made out of waterproof material;

(b) said tarp having a side length defining a border;

(c) said tarp having grommets or ties at the corners and elsewhere along the borders;

(d) said tarp having a hood attached on the top side along a diagonal line of said tarp and centered on said line so that is said tarp is folded along said diagonal line and said hood placed on a users head, said tarp will lie on the users shoulders like a rain cape;

(e) said tarp having fasteners attached on the top side along said diagonal line arranged symmetrically about said hood so that fasteners on one side of said hood will match fasteners on the other side of said hood, so that if said tarp is folded along said diagonal and said tarp is draped over said users shoulders, the fasteners will mate in front of said user;

(f) said trap having straps attached on the top side along said diagonal line arranged symmetrically about said hood so that a strap on one side of said hood will match a strap on the other, so that if said tarp is folded along said diagonal line and draped over said users shoulders, the straps can attach said folded tarp to said users neck like a cape;

(g) said tarp fasteners attached to a bottom side along two adjacent edges;

(h) a triangular sheet made of netting or breathable fabric with two equal sides being of the same length as a side of said tarp;

(i) said triangular sheet having fasteners on the equal sides that match the fasteners on the bottom side of said tarp so that said triangular sheet and said tarp is combinable into a tent;

(j) said tent being pitchable by tying the corner between said bottom side fasteners to a support about 70% the height of said tarps side and then staking out other corners and sides of said tarp;

(k) said tent, when pitch, will enclose a volume on the sides and top.

* * * * *